United States Patent [19]

Krein

[11] 4,251,975

[45] Feb. 24, 1981

[54] METHOD AND APPARATUS FOR STUFFING CUSHIONS, MATTRESSES, AND THE LIKE

[75] Inventor: Reuben J. Krein, Fort Smith, Ark.

[73] Assignee: Coachmen Industries, Inc., Middlebury, Ind.

[21] Appl. No.: 70,015

[22] Filed: Aug. 27, 1979

[51] Int. Cl.[3] ..... B65B 63/02

[52] U.S. Cl. ..... 53/438; 53/524; 53/529

[58] Field of Search ..... 53/438, 436, 524, 526, 53/528, 529, 523

[56] References Cited

U.S. PATENT DOCUMENTS

| | | | |
|---|---|---|---|
| 3,546,846 | 12/1970 | Sens | 53/438 X |
| 4,016,707 | 4/1977 | Puchosic | 53/436 X |

*Primary Examiner*—Travis S. McGehee

*Attorney, Agent, or Firm*—Oltsch, Knoblock & Hall

[57] ABSTRACT

An apparatus for stuffing cushions, mattresses, and the like. The apparatus includes a cantilevered hollow support with multiple perforations in its upper wall and selectively operable means for evacuating air from the hollow support. Cushion stuffing material is placed on the support and covered with an air impervious film advanced from a supply member carried by the apparatus and cut by a cutter adjustably mounted on the apparatus. The film closes exposed perforations of the support which are not covered by the stuffing material. The apparatus is used to evacuate the air from the stuffing material, thereby shrinking the material to allow the rapid application of a cover over the stuffing and support, followed by withdrawal of the cover and contained stuffing from the support.

8 Claims, 12 Drawing Figures

METHOD AND APPARATUS FOR STUFFING CUSHIONS, MATTRESSES, AND THE LIKE

SUMMARY OF THE INVENTION

This invention relates to an apparatus for stuffing cushions, mattresses, and the like.

In the apparatus of this invention, a hollow support panel perforated at its upper wall is adjustably cantilevered from a base. A selectively operable source of subatmospheric pressure is connected to the interior of the hollow support panel and is controlled by a manually operable valve associated with the base. A rack is mounted on the base which may accommodate a roll of flexible, air impervious film material. A cutter device is provided for cutting a portion of the film material of selected size fed from the roll on the rack. The cutter is adjustably positioned between the proximal and distal ends of the support. Clamp means are provided for releasably positioning the support panel upon the base whereby support panels of various sizes which are correlated to different cushion sizes may be secured to the base.

Stuffing cushions with this apparatus involves the placing of resilient, compressible, cushion stuffing material upon the support, covering the stuffing material and exposed support perforations with an air impervious film, evacuating the air from the material whereby atmospheric pressure compresses the stuffing material to a reduced size, slipping a cover over the support and stuffing material, and sliding the stuffing, film, and cover from the support. Atmospheric air enters the stuffing material whereby it expands to fill the cover.

An object for this invention is to provide a method and apparatus for stuffing cushions and the like which uses a vacuum to evacuate the air from a flexible stuffing material and thereby reduce the volume of the stuffing material.

Another object is to provide an apparatus for stuffing cushions and the like which employs a releasable cantilevered hollow perforated stuffing support.

Another object is to provide an apparatus for stuffing cushions and the like in the use of which an air impervious film is applied over the stuffing material and the exposed perforations of a hollow cushion support while air is withdrawn therefrom to collapse the material thereon.

Another object is to provide an apparatus for stuffing cushions and the like wherein a cutter is adjustably positionable along a hollow perforated stuffing support between the proximal and distal ends of the support.

Another object is to provide an apparatus for stuffing cushions and the like which includes a rack for rotatably supporting a roll of air impervious film material.

Another object is to provide an apparatus for stuffing cushions and the like in which a cantilevered hollow perforated stuffing support is easily and rapidly removable from and replaceable upon the base of the apparatus.

Another object is to provide an apparatus for stuffing cushions and the like which is economical and efficient in use and is simple in design.

Other objects will be apparent from the following specification.

DESCRIPTION OF THE PREFERRED EMBODIMENTS

The preferred embodiments illustrated are not intended to be exhaustive nor to limit the invention to the precise forms disclosed. They are chosen and described to explain the principles, application, and practical use of the invention and to enable others skilled in the art to utilize the invention.

Figure 1:
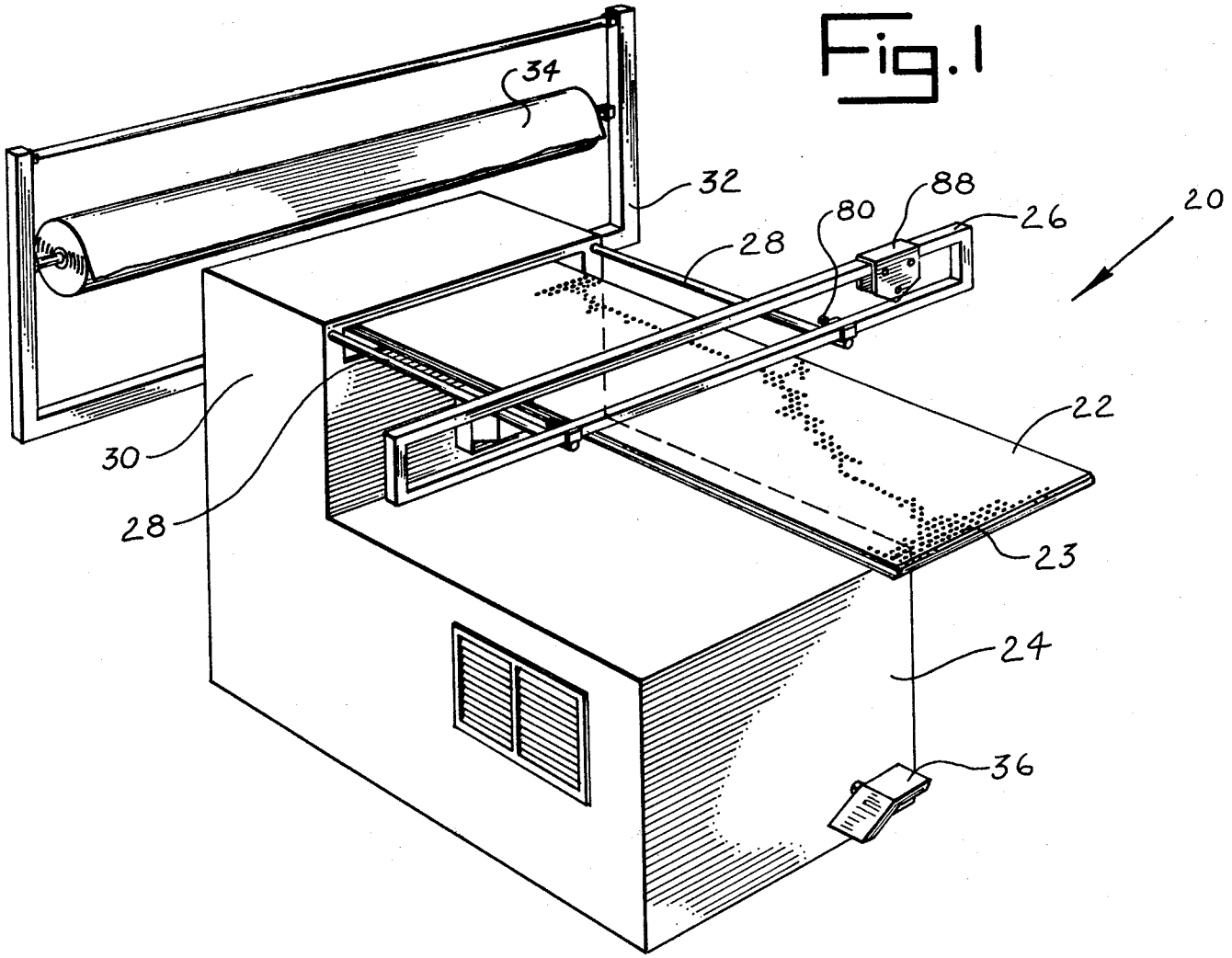
FIG. 1 is a perspective view of one embodiment of this invention.

With reference to FIG. 1, the cushion stuffing apparatus 20 of this invention includes a hollow support panel 22 having perforations 23 at its upper wall. Panel 22 is releasably supported in cantilevered position upon a cabinet or base 24. A cutter device 26 is slidably mounted and selectively positionable relative to the support panel 22 by parallel guide rods 28 which project from the frame of cutter device 26 and are slidably received in guide openings in the upper portion 30 of base 24. A rack 32 for rotatably supporting one or more rolls 34 of air impervious film material is secured to portion 30 of base 24. A pedal 36 is pivoted to base 24 for use by an operator to control means for evacuating air from the chamber of hollow support panel 22.

Figure 2:
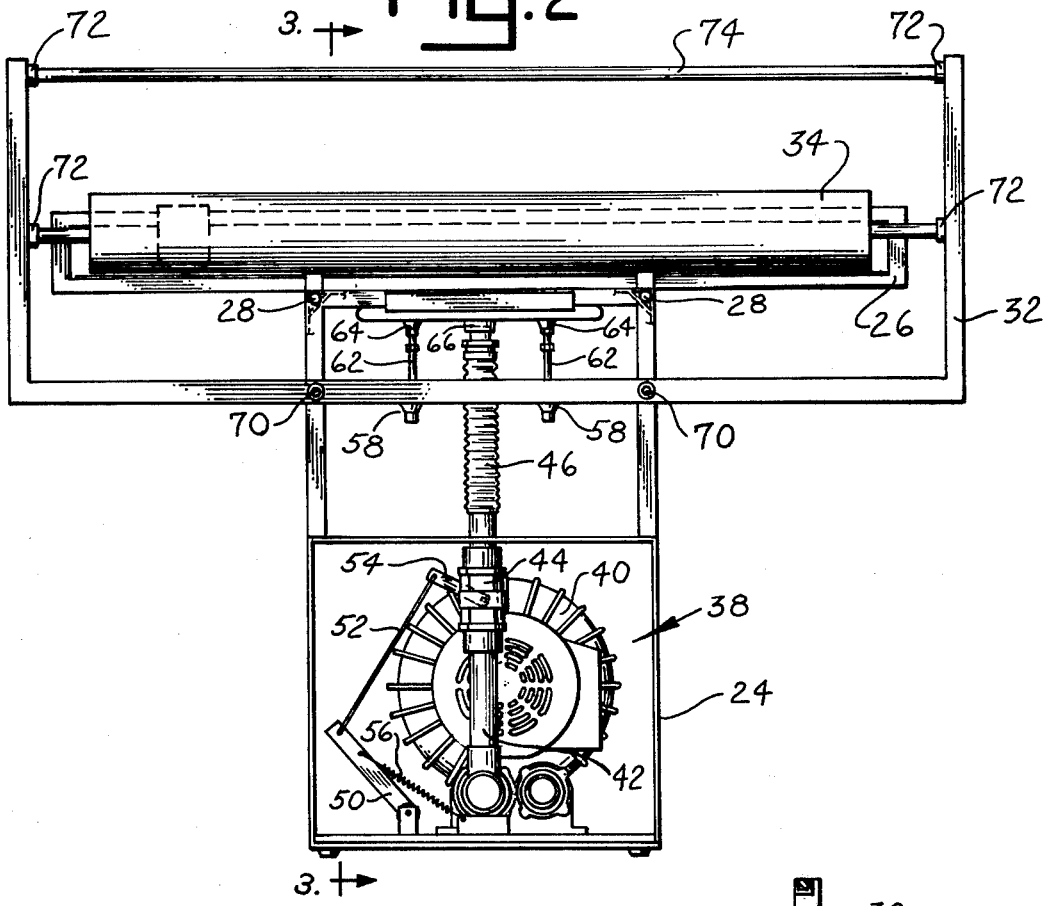
FIG. 2 is a rear elevation view of the apparatus.
Figure 3:
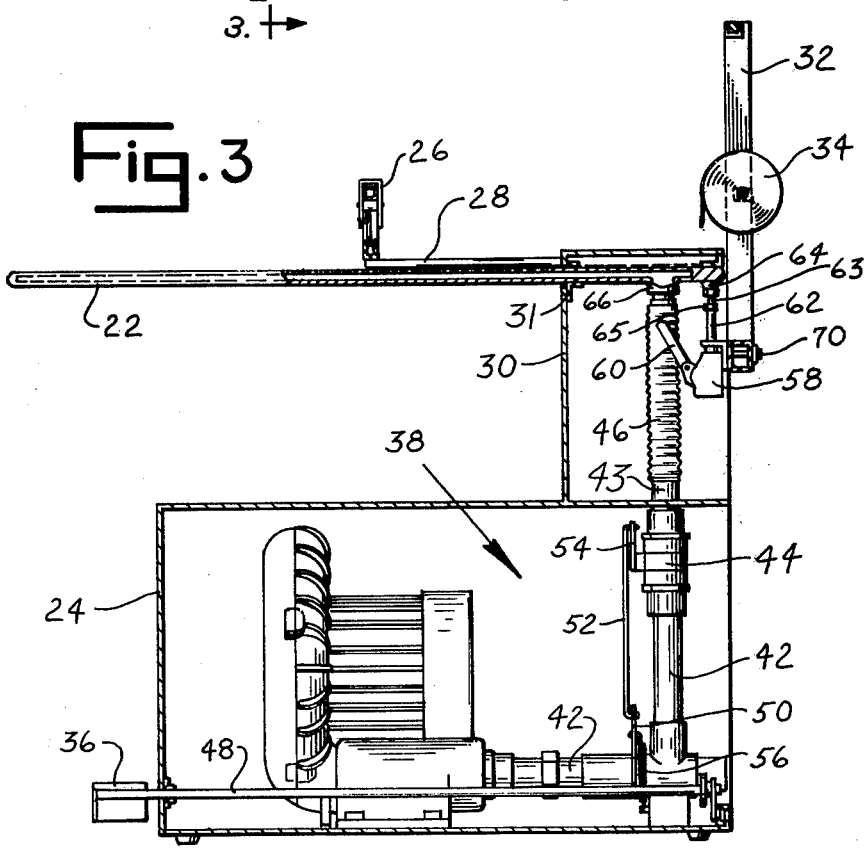
FIG. 3 is a sectioned elevational view of the apparatus taken along the line 3—3 of FIG. 2.

As illustrated in FIGS. 2 and 3, means 38 for generating a subatmospheric pressure may be located within base cabinet 24. The means 38 illustrated includes a motor-driven vacuum pump 40 connected by conduit 42 having a valve 44 interposed therein. A length of flexible conduit 46 releasably connects the intake end 43 of conduit 42 to a nipple 66 projecting from the adjacent end portion of hollow support panel 22. The valve 44 is operable by foot pedal 36 which is mounted on the end of a shaft 48 journaled in the base cabinet 24. A lever 50 is secured to shaft 48 and a rod 52 is pivotally connected at its one end to lever 50 and at its opposite end to the operating lever 54 of valve 44. A spring 56 urges the linkage connected to valve 44 toward a normally closed valve position, i.e., through lever 50, rod 52, and valve operating lever 54.

Support panel 22 is preferably supported in releasable cantilevered position on base cabinet 24. One vertical wall of the base cabinet has an opening at 31 to receive and support panel 22 spaced from nipple 66. The cabinet part 30 is open at the side thereof opposite that having the opening 31. A pair of toggle clamps 58 are mounted in the upper portion 30 of base 24 spaced from guide opening 31 and secure the end portion of support panel 22 thereto when in their locked position, as shown. Each toggle clamp 58 includes a pivoted lever 60 by means of which clamping members or rods 62 may be shifted between a position locking the hollow panel 22 in place, as shown, and a position releasing hollow panel 22. Each clamping member 62 preferably carries at its panel-engaging end a resilient cushion member 64 which contacts the underside of support panel 22 and forcefully, frictionally locks the support panel 22 to the base 24 when the clamps 58 are in their locking position. Each clamping member 62 may be tubular and preferably includes a threaded telescoping extensible part 63 threaded into the part 62 and by means of which the length of clamping member 62, and the force applied at its engagement with support panel 22, may be adjusted. A nut 65 may be carried by part 63 and may engage the end of member 62 to lock the two parts of the clamping member 62 in a selected combined length.

Figure 4:
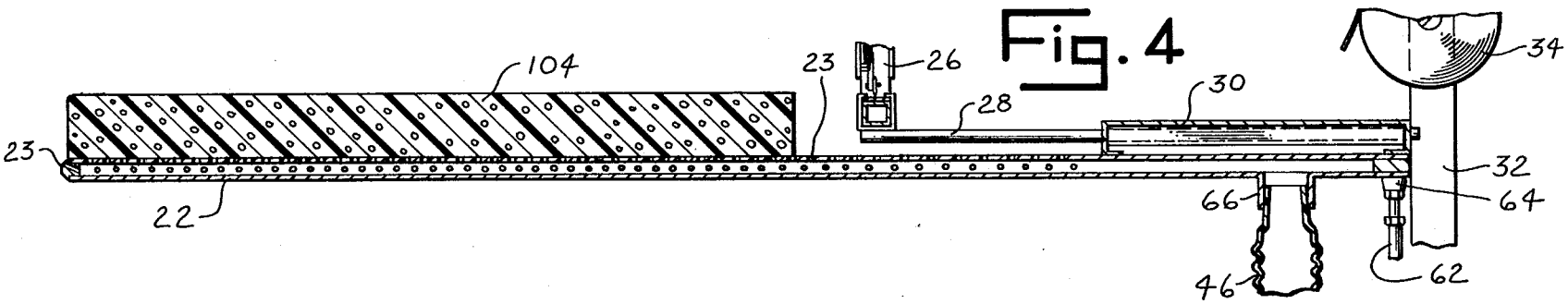
FIG. 4 is an enlarged fragmentary sectional view taken alone line 3—3 of FIG. 2 and showing cushion stuffing material resting on the apparatus in preparation for the application of a cover thereover.
Figure 5:
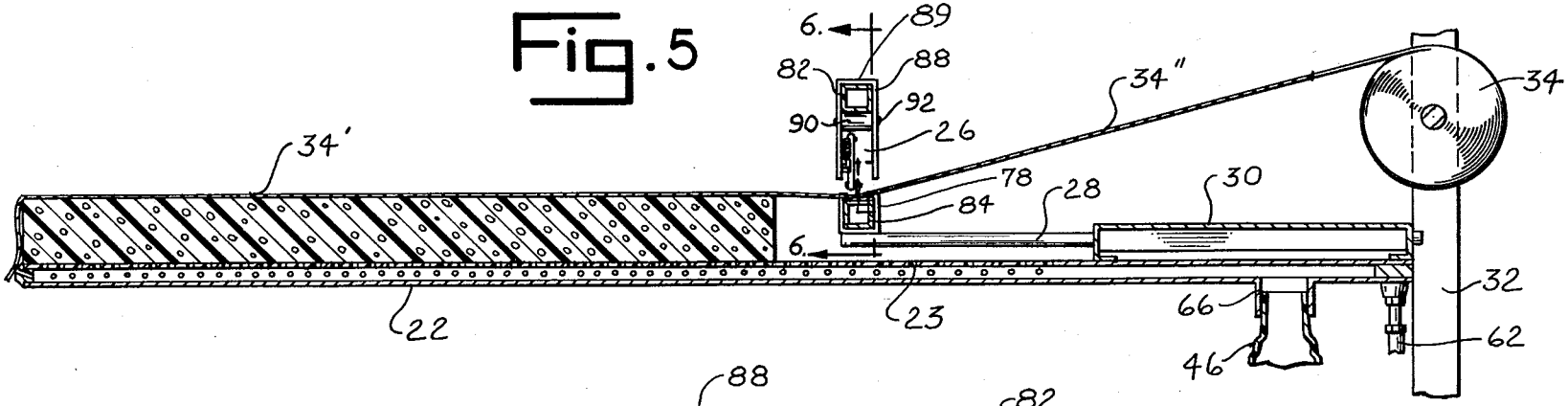
FIG. 5 is a fragmentary section view taken along line 3—3 of FIG. 2 and showing the application over cushion stuffing material of an air impervious film.
Figure 7:
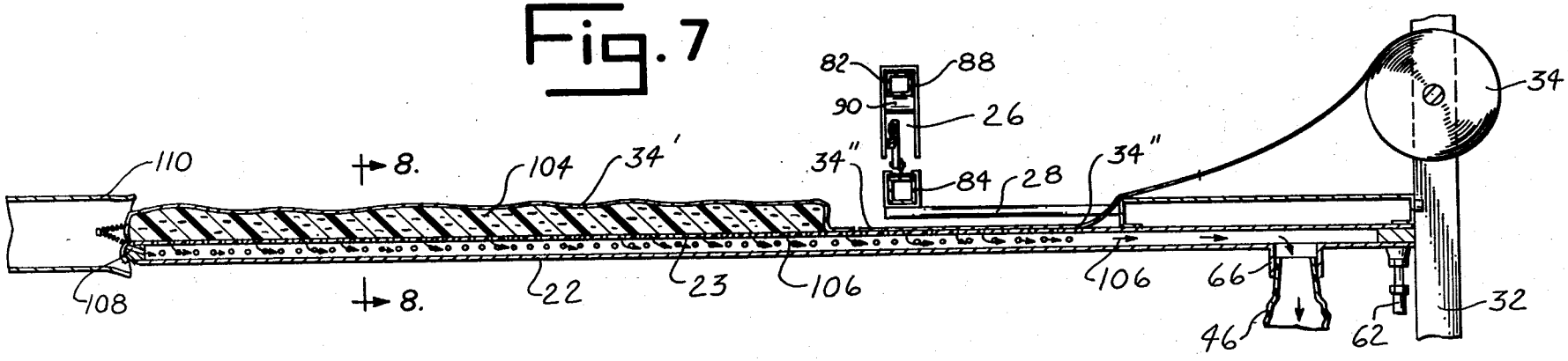
FIG. 7 is a fragmentary sectional view taken along line 3—3 of FIG. 2 and showing the reduction of size of a stuffing material upon evacuation of the air from the hollow support and the material.
Figure 8:
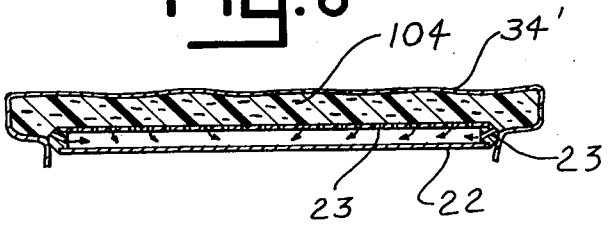
FIG. 8 is a sectional view taken along the line 8—8 of FIG. 7 and showing the evacuated and compressed film-covered stuffing material overhanging the margins of the support.

As illustrated in FIGS. 1, 4–5, 7–9, support panel 22 is hollow and has multiple perforations 23 in the portion of its upper wall which projects from the base 24. The margins of support panel 22 are chamfered and the upper margin chamfer, as seen in FIGS. 1, 5 and 8, preferably also has perforations 23 therein. All of these perforations communicate with the interior chamber of support panel 22 and with the vacuum source 38 through conduits 42 and 46 under control of valve 44.

A frame member or rack 32 is secured to the upper portion 30 of base 24, for example by bolt and nut fasteners 70. Rack 32 is generally "U" shaped and each upright part thereof has cradles 72 secured thereto. Cradles 72 are generally "U" shaped and releasably receive and support the ends of a rod 74 which may be inserted through the central opening of a film material roll 34 to rotatably support the roll.

Figure 6:
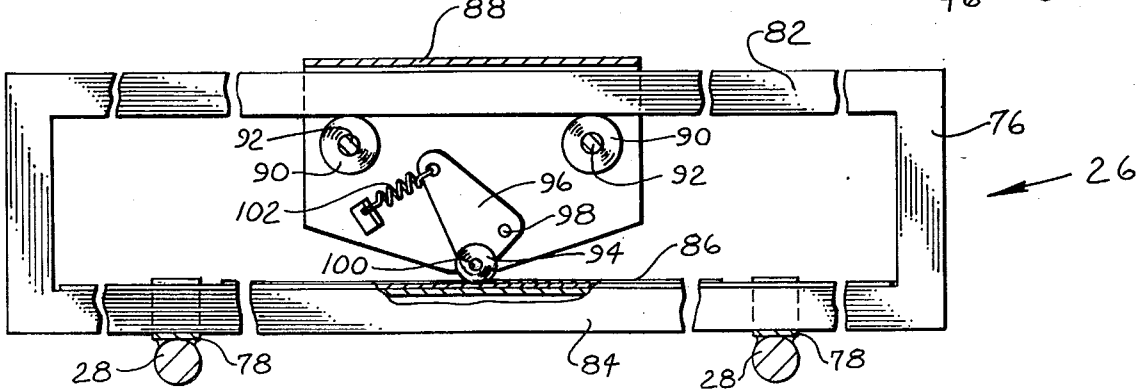
FIG. 6 is a view of the cutter assembly taken along the line 6—6 of FIG. 5.

Cutter device 26 is illustrated in FIG. 6, and includes an open vertical rectangular frame 76. Frame 76 may be removably secured to spaced parallel guide rods 28 by clamps 78. Each clamp 78 may have a set screw 80 (shown in FIG. 1) which clamps it to the frame 76 when tightened thereagainst. In cross section, the horizontal members 82 and 84 of frame 76 are generally rectangular. A metal strip 86 is preferably carried by the upper surface of lower frame member 84. A carriage 88 is slidably carried and guided by upper frame member 82. Carriage 88 is generally of inverted "U" shape. A pair of rollers 90 rotate on transverse pins 92 which span the interior of carriage 88 at positions spaced below the upper cross member 89 of the carriage a distance greater than the vertical transverse dimension of frame member 82. Rollers 90 normally contact the lower surface of frame member 82. A sharp-edged cutter disc 94 is journaled at 100 upon pivot member 96 which is rotatable about pin 98 attached to the lower side portions of carriage 88. Disc 94 projects below the sides of carriage 88 adjustably under control of a spring 102 which biases pivot member 96 to a position urging cutter disc 94 against strip 86 carried by lower frame member 84. Also, spring 102 shifts the carriage upwardly to a position in which rollers 90 engage the frame member 82.

Figure 9:
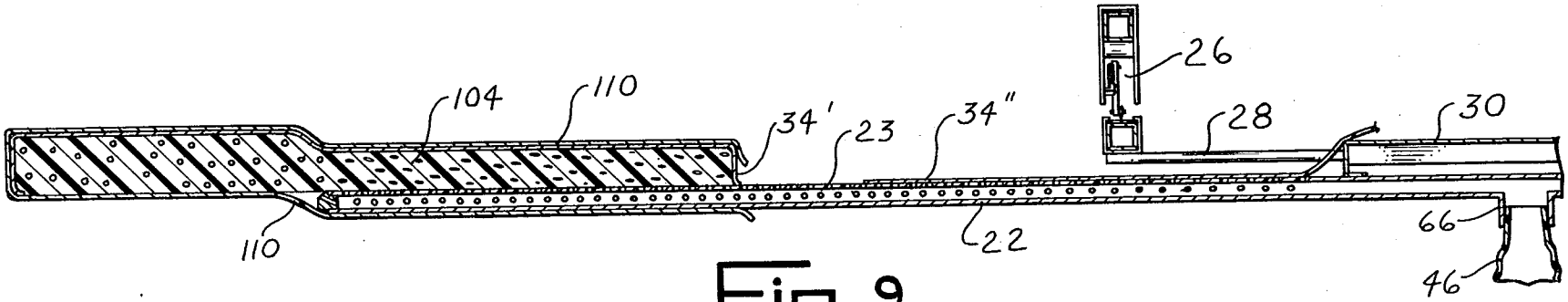
FIG. 9 is a sectional view taken along the line 3—3 of FIG. 2 and showing the cushion stuffing material enclosed within a cover of upholstery material and partially removed from the support.
Figure 10:
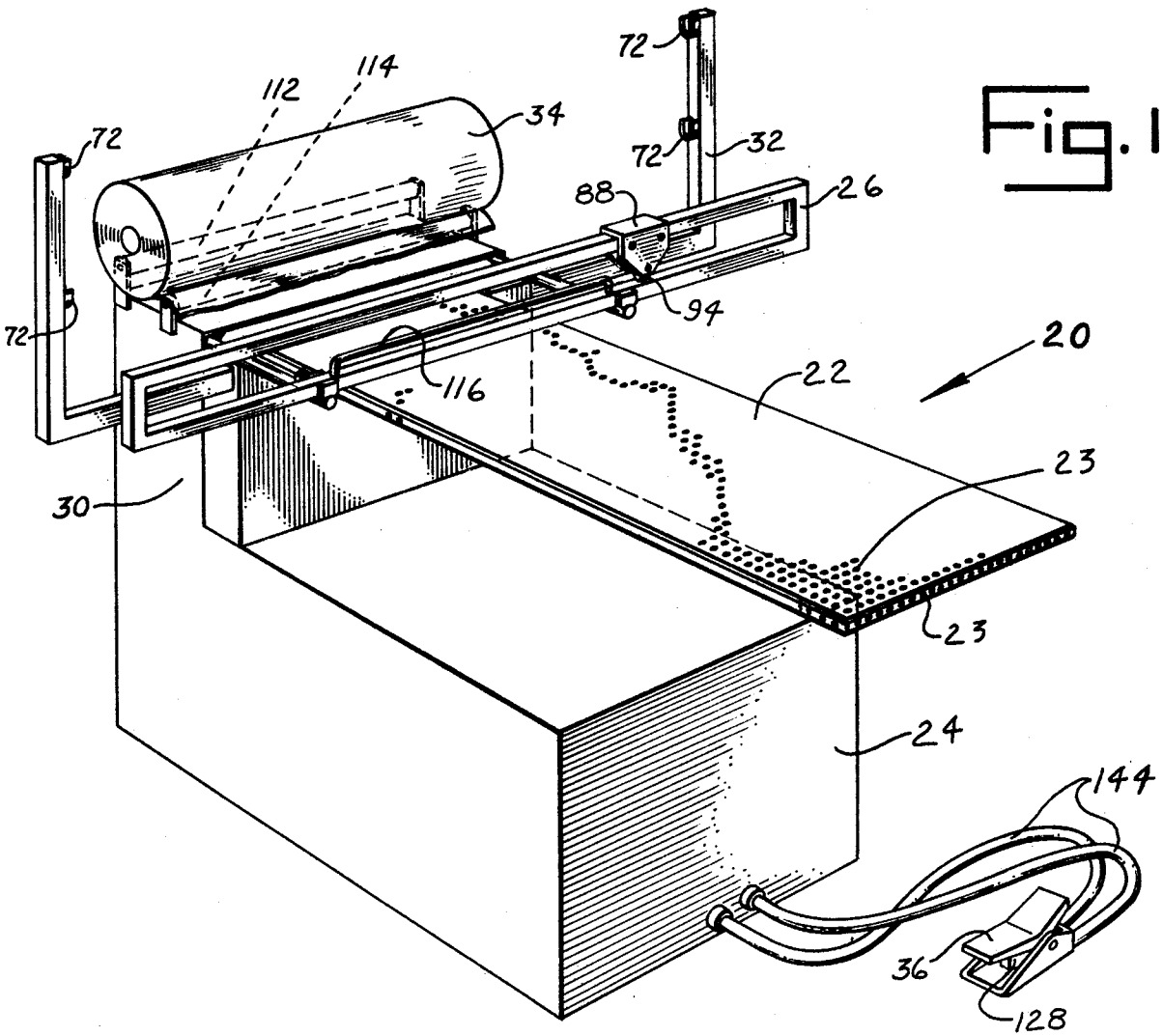
FIG. 10 is a perspective view of another embodiment of this invention.
Figure 11:
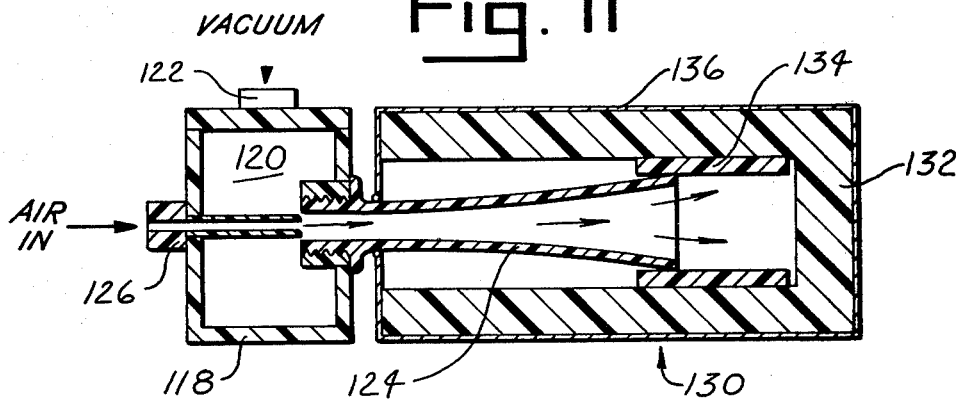
FIG. 11 is a sectional side elevational view of a means for generating a subatmospheric pressure.
Figure 12:
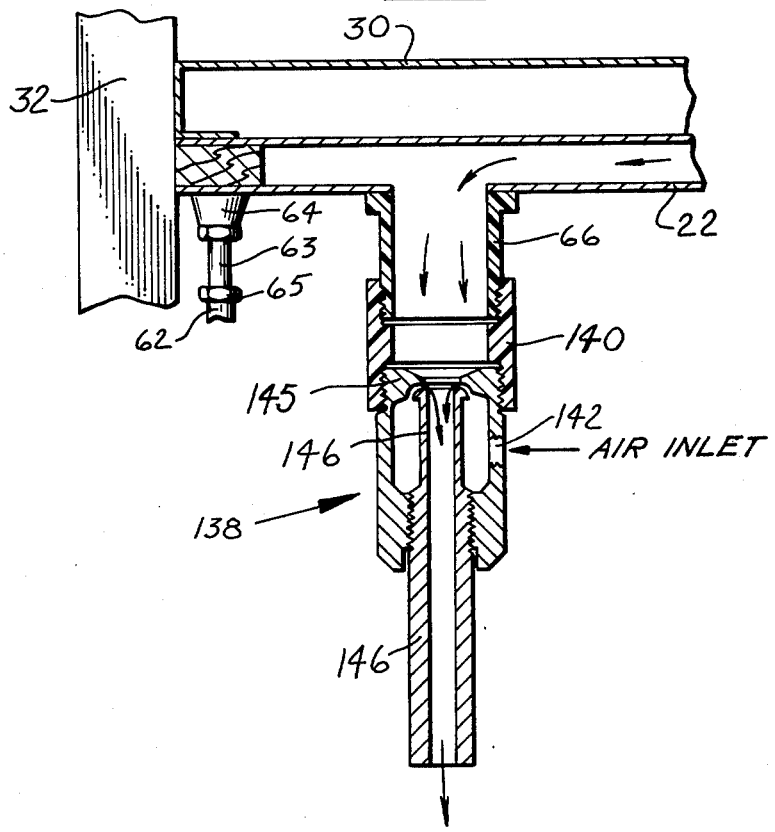
FIG. 12 is a sectional side elevational view of another means for generating a subatmospheric pressure.

FIGS. 10–12 illustrate additional embodiments of this invention, in which components analagous in function to those in FIGS. 1–9 are referred to by the same numerals.

The FIG. 10 embodiment includes parallel rollers 112, 114, journaled in brackets and spaced above the upper wall of housing upper portion 30. Rollers 112, 114, are so spaced and positioned that a roll of film material 34 may rest upon them for rotation as film material is pulled from the roll toward the free projecting end of the upper support panel 22.

Cutter disc 26 includes a shallow "U" shaped guide bar 116 which is carried by the lower member 84 of frame 76. The horizontal part of guide bar 116 is preferably spaced above the top surface of member 84 and is positioned laterally of the path of cutter disc 94 of carriage 88. If desired, frame 32 may be provided as an alternative support for film roll 34.

FIGS. 11 and 12 illustrate alternative constructions of air flow control means. The construction shown in FIG. 11 includes a housing 118 having a chamber 120 which communicates with the interior chamber of support panel 22 and has a nipple 122 for connection with support panel 22, as by a conduit (not shown). Housing 118 carries an air intake nozzle 126 projecting therein and adjacent to and aligned with the reduced diameter end of a flaring tube 124 to form an aspirator evacuating air from chamber 118. Nozzle 126 is preferably connected through conduits 114 (FIG. 10) to a supply of compressed air under control of a valve 128. Flaring tube 124 preferably discharges into a silencer 130 which may include a cylinder 132 formed of an air permeable material, for example glass wool, and having a sleeve 134 of plastic material fitted therein and surrounding the large open end of tube 124. Silencer 130 may preferably include a cover 136 formed of elastic, air permeable fabric.

FIG. 12 illustrates yet another aspirating means for generating a subatmospheric pressure in panel 22. In this embodiment, aspirator 138 may be directly connected to nipple 66 of support panel 22, as by an internally threaded sleeve 140. Aspirator 138 is connected to a source of compressed air at port 142, as through the conduits 144 under control of a valve 128. Aspirator 138 has a restricted annular end part 145 connected to sleeve 140 and an outlet tube 146 projecting into the aspirator housing past inlet port 142 to terminate adjacent to port 144.

The use of this apparatus in practice of the method of stuffing cushions is illustrated in FIGS. 4, 5, 7–9. FIG. 4 shows a cushion stuffing material 104 resting upon support panel 22 near the free end thereof. Material 104 is of a resilient, compressible character, for example, expanded aerated open cell monomer or polymer foam, feathers, down, or kapok. Cutter device 26 is adjusted to a convenient working position along support panel 22 spaced from stuffing material 104 as will be determined by the size of cushion being stuffed and the preference of the operator.

FIG. 5 illustrates the draping of a portion 34' of air impervious film withdrawn from roll 34 over the stuffing material 104. As illustrated, the film is inserted through the open frame 76 of cutter 26 and unrolled from roll 34 to cover the material 104 and drape over the edges thereof and of panel 22. Carriage 88 of cutter 26 is then moved to traverse the cutter frame member 82 and cause cutter disc 94 to sever the film spaced from the stuffing material 104 sufficiently to provide a margin of the severed portion adequate to drape over the adjacent margin of stuffing material 104. The film portion 34'' may then be advanced under the cutter frame to a position adjacent stuffing material 104 covering panel 22. As seen in FIG. 7, the free end portion 34'' of the film overlies and seals perforations 23 of support panel 22 not covered by material 104. As illustrated, when the air is evacuated from support panel 22 and material 104 (represented by the arrows 106) through conduit 46, for example as controlled by foot pedal 36, the stuffing material 104 is compressed or shrunken to a reduced size and thickness by atmospheric pressure acting on the film 34' covering the stuffing material. Free end portion 34'' of film 34 seals those perforations 23 of panel 22 which are not covered by stuffing material 104 and thereby prevents the admission of air therethrough so that reduction of vacuum in the stuffing material is minimized. The perforations 23 at the marginal chamfers 108 of support panel 22 over which margins of film 34' are draped are also sealed, said film margins being drawn into sealing engagement with support panel 22 by the pressure differential at opposite faces of the film. Stuffing material 104 will preferably be compressed by the pressure differential to such an extent that the combined thickness of the material 104 and support panel 22 is less than the normal expanded thickness of the stuffing material 104. Thus, as shown in FIG. 7, a cover 110 which is produced in a size for snug fit of stuffing material 104 therein, and which is opened at a portion of its margin, may be slipped over the panel 22 and the shrunken stuffing material 104. Cover 110 will usually be adapted to be closed, as by a slide fastener.

After the cover 110 has been slipped over panel 22 and material 104, the vacuum applied to the chamber of support panel 22 may be released, under control of pedal 36, and the stuffing material 104, film 34', and cover 110 are slid off of support panel 22 as a unit while the material 104 expands to normal size. FIG. 9, illustrates a stuffed and covered cushion partially removed from support panel 22 as the material 104 expands to snugly fill cover 110.

It will be understood that this invention may be used to stuff a great variety of objects which vary greatly in size. To this end, support panel 22 may be of a size and configuration to accommodate the item to be stuffed. Any of a variety of supports of different sizes and shapes may be selected and secured to apparatus 20 by insertion of a part thereof through chamber opening 31 and manipulation of toggle clamps 58, thereby to adjust the apparatus to the need of a user.

In some cases it may be desirable to use an embodiment of cutter device 26 including guide bar 116 (FIG. 10) to position film 34 in proper relation to panel 22 and stuffing material 104 as it is drawn from the roll preparatory to severing of portion 34 by operation of the cutter.

It will be understood that this invention is not to be limited to the precise form disclosed but that changes thereof may be made within the scope of the appended claims.

What I claim is:

1. An apparatus for stuffing cushions comprising;

a base, a hollow support panel having a perforated upper wall, means on said base releasably locking said support panel in selected cantilevered position on said base, said support panel being adapted to support cushion stuffing material, flexible air impervious sheet material spanning said stuffing material and spanning and draped upon said support to define an enclosure for said stuffing material substantially impervious to ambient air, and, means for selectively generating a sub-atmospheric pressure within said hollow support and said enclosure.

2. The apparatus of claim 1 wherein a marginal edge of said support panel is perforated, said perforations and the edges of said stuffing material being spanned by marginal portions of said sheet material draped thereover.

3. The apparatus of claim 1 and means carried by said base for rotatably supporting a roll of said sheet material spaced from the free end of said support panel, and a cutter device adjustably supported on said base for transversely severing film material between stuffing material on said support panel and said roll supporting means.

4. The apparatus defined in claim 3, wherein said cutter device comprises;

a frame having upper and lower spaced horizontal members extending transversely relative to said support panel, a carriage shiftable along the upper horizontal member, a sharp-edged cutter disc journaled in said carriage and spring urged against the lower horizontal member, and a film sheet supported thereby, whereby advance of said carriage on said frame severs said film sheet.

5. The apparatus of claim 3, wherein said cutter device includes a frame carried by an elongated guide member and means on said base adjustably supporting said guide members in selected relation to said support panel.

6. The apparatus of claim 1 wherein said means for generating a subatmospheric pressure is a motor-driven suction pump and releasable means connecting said pump to said releasable support panel.

7. The apparatus of claim 1 wherein said means for generating a subatmospheric pressure is an aspirator connected to a source of compressed fluid and to said hollow support panel.

8. The method of stuffing a cushion consisting of the steps of:

positioning an aerated stuffing material upon a cantilevered hollow support panel having a perforated upper wall and connected to a selectively operable means to deaerate said hollow support panel, advancing a portion of a sheet of air impervious flexible sheet material from a roll supported adjacent said support panel, cutting a portion of said sheet of a size sufficient to span said stuffing material and drape the margins thereof, positioning sheet material to span substantially all perforations of said support panel spaced from said stuffing material, deaerating said support panel and the stuffing material thereon to shrink said material, applying a cover of a size to normally snugly receive said stuffing material around the stuffing material and the supporting panel, and withdrawing said cover and contained stuffing material and sheet material from said support panel.

* * * * *